US007900606B2

(12) United States Patent
Lucido et al.

(10) Patent No.: US 7,900,606 B2
(45) Date of Patent: Mar. 8, 2011

(54) SYSTEMS AND METHODS FOR PURGING AIR OF A FUEL INJECTION SYSTEM

(75) Inventors: Michael J. Lucido, Northville, MI (US); Mark D. Carr, Fenton, MI (US)

(73) Assignee: GM Global Technology Operations, Inc.

( * ) Notice: Subject to any disclaimer, the term of this patent is extended or adjusted under 35 U.S.C. 154(b) by 213 days.

(21) Appl. No.: 12/390,720

(22) Filed: Feb. 23, 2009

(65) Prior Publication Data

US 2010/0212640 A1 Aug. 26, 2010

(51) Int. Cl.
*F02M 37/20* (2006.01)
*F02M 37/22* (2006.01)

(52) U.S. Cl. ..... 123/516

(58) Field of Classification Search ..... 123/516, 123/179.9, 179.12, 179.17; 701/103, 113, 701/115

See application file for complete search history.

(56) References Cited

U.S. PATENT DOCUMENTS 4,836,157 A * 6/1989 Miller ..... 123/179.11
5,095,880 A * 3/1992 Ricks ..... 123/516

* cited by examiner

*Primary Examiner* — Mahmoud Gimie

(57) ABSTRACT

A system for a vehicle includes an initialization module and a purge control module. The initialization module generates an initialization signal based on a crankshaft speed signal and/or a fuel rail pressure signal. The initialization module also generates the initialization signal based on an initial purge value and an assembly-line monitoring value. The purge control module generates a purge signal to purge air from a fuel injection system of an engine. The purge signal is generated when the crankshaft speed signal indicates that a crankshaft of the engine is stationary and/or the fuel rail pressure signal indicates that a fuel rail pressure is less than a predetermined value. The purge signal is also generated based on the initialization signal.

16 Claims, 4 Drawing Sheets

SYSTEMS AND METHODS FOR PURGING AIR OF A FUEL INJECTION SYSTEM

FIELD

The present disclosure relates to vehicle control systems for internal combustion engines, and more particularly to fuel injection control systems.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Spark ignition direct injection (SIDI) systems are currently used by many engine manufacturers. In a SIDI system, highly pressurized gasoline is injected directly into cylinders of an engine. This is different than port fuel injection where fuel is injected into an intake manifold or port upstream from an intake valve of a cylinder.

SIDI technology enables stratified fuel-charged combustion for improved fuel efficiency and reduced emissions at low load. The stratified fuel charge allows for a lean burn and improves fuel efficiency and power output.

SIDI engines may be configured with a low-pressure fuel pump and a high-pressure fuel pump, which are used for pressurizing respectively a low-pressure fuel line and an injector fuel rail. A pressure sensor is attached to the fuel rail and generates a fuel rail pressure signal for feed back control of fuel rail pressure.

SUMMARY

Accordingly, a system includes an initialization module that generates an initialization signal. The initialization signal is generated based on a crankshaft speed signal and at least one of an initial purge value and an assembly-line monitoring value. A purge control module generates a purge signal to purge air from a fuel injection system of an engine when the crankshaft speed signal indicates that a crankshaft of the engine is stationary and based on the initialization signal.

In other features, a system includes an initialization module that generates an initialization signal. The initialization signal is generated based on a fuel rail pressure signal and at least one of an initial purge value and an assembly-line monitoring value. A purge control module generates a purge signal to purge air from a fuel injection system of an engine when the fuel rail pressure signal is less than a predetermined value and based on the initialization signal.

In other features, a method of purging air from a fuel injection system is provided. The method includes generating an initialization signal based on a crankshaft speed signal, a fuel rail pressure signal, and at least one of an initial purge value and an assembly-line monitoring value. A purge signal is generated when the crankshaft speed signal is zero and the fuel rail pressure signal is less than a predetermined value and based on the initialization signal.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
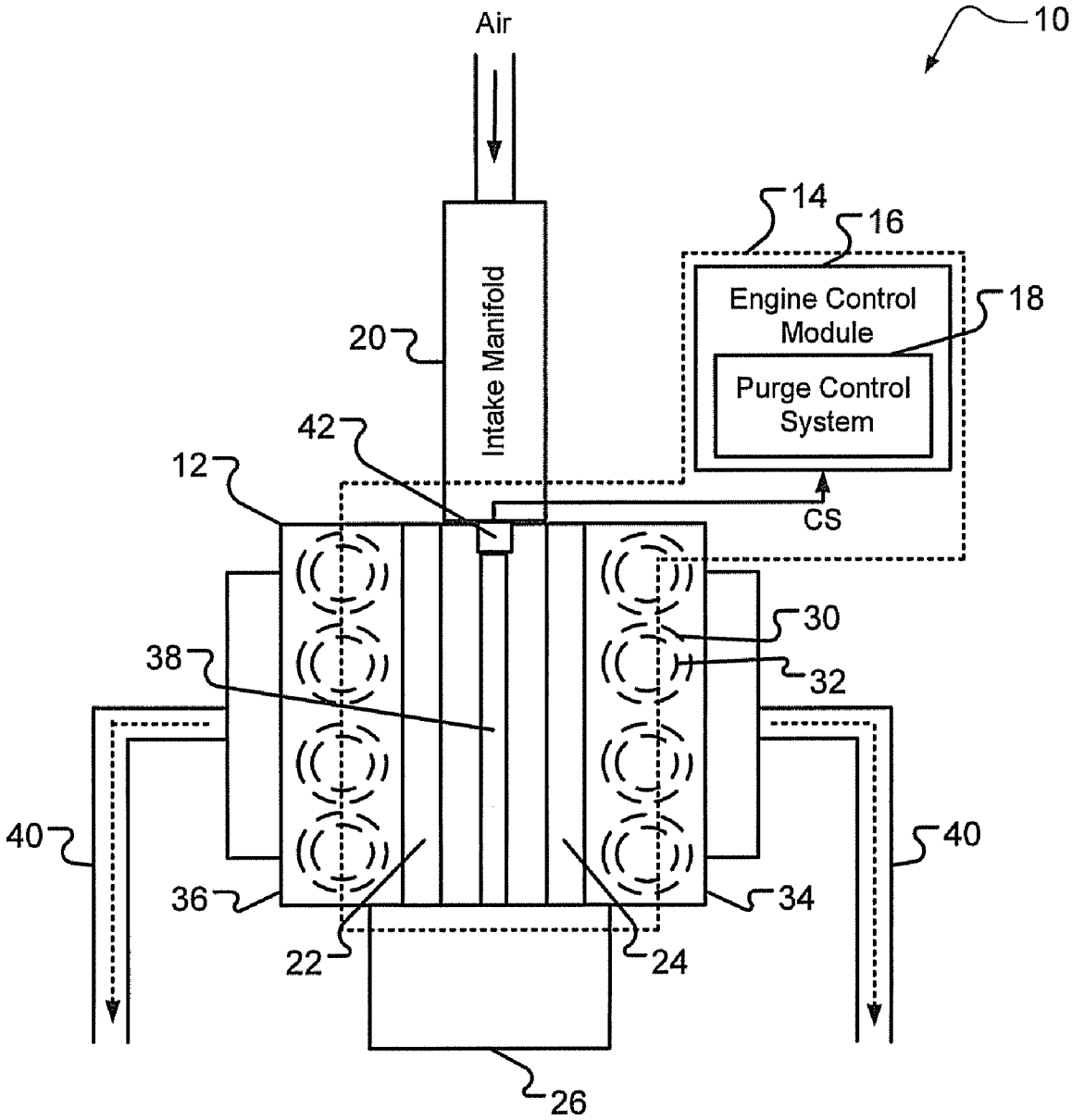
FIG. 1 is a functional block diagram of an engine system in accordance with an embodiment of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

In addition, although the following embodiments are described primarily with respect to a SIDI engine, the embodiments of the present disclosure may apply to other types of engines. For example, the present invention may apply to compression ignition, spark ignition, spark ignition direct injection, homogenous spark ignition, homogeneous charge compression ignition, stratified spark ignition, diesel, and spark assisted compression ignition engines.

After a vehicle is built at a manufacturing facility, the engine of the vehicle is started near the end of an assembly process. The starting of the engine includes cranking of the engine and activating ignition and fuel injection systems. Prior to a first engine start, the fuel injection system is primed.

During the prime of the fuel injection system, the low-pressure fuel pump may be activated to pump fuel into and/or through components of the fuel injection system and to provide a predetermined pressure in the fuel injection system. The engine may need to be cranked for an extended period of time in order to purge the air from the fuel injection system. The air in the fuel injection system may cause the engine to not start or start erratically.

The embodiments of the present disclosure provide injector purge systems and methods for removing air within a fuel injection system after manufacturing of a vehicle and before starting of an engine of the vehicle. The injector purge systems and methods reduce engine crank times after vehicle assembly is complete.

Figure 2:
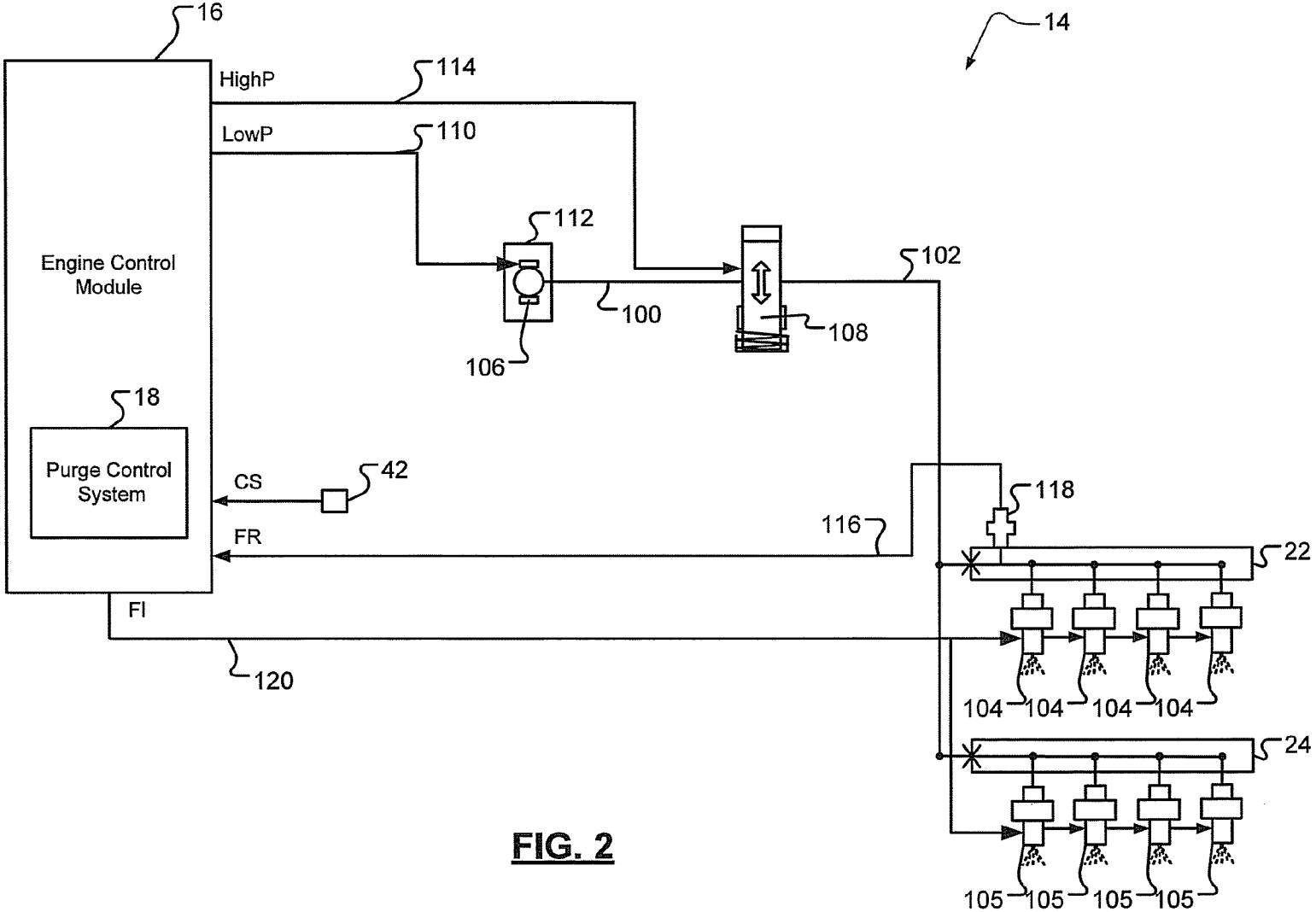
FIG. 2 is a functional block diagram of a fuel injection system in accordance with an embodiment of the present disclosure.
Figure 3:
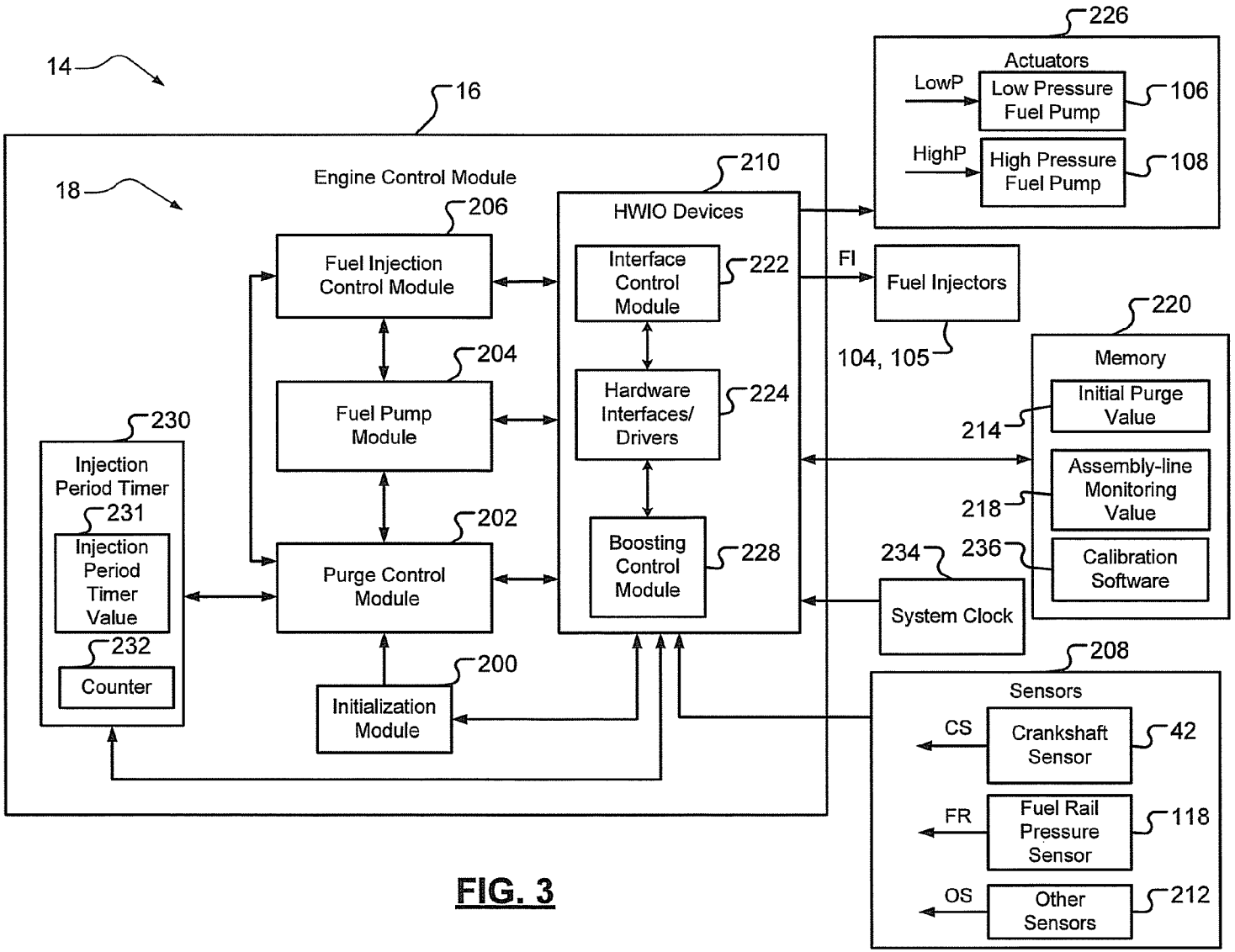
FIG. 3 is a functional block diagram of the fuel injection system of FIG. 2 illustrating a purge control system in accordance with another embodiment of the present disclosure.

Referring now to FIG. 1, an exemplary engine control system 10 of a vehicle is schematically illustrated in accordance with the present disclosure. The engine control system 10 includes an engine 12 and a fuel injection system 14. The fuel injection system 14 includes an engine control module 16 with an injector purge control system 18. The injector purge control system 18 controls purging of the fuel injection system 14 upon manufacture of a vehicle to remove trapped air from the fuel injection system 14. Examples of the engine control module 16 and the purge control system 18 are shown in FIGS. 2 and 3.

The engine 12 includes an intake manifold 20, the fuel injection system 14 with fuel rails 22, 24, a transmission 26, a cylinder 30, and a piston 32. The exemplary engine 12 includes eight cylinders 30 configured in adjacent cylinder banks 34, 36 in a V-type layout. Although FIG. 1 depicts eight cylinders (N=8), it can be appreciated that the engine 12 may include any number of cylinders 30. It is also anticipated that the engine 12 can have an inline-type cylinder configuration. While a gasoline powered internal combustion engine utilizing direct injection is shown, the embodiments disclosed herein apply to diesel or alternative fuel sourced engines.

During engine operation, air is drawn into the intake manifold 20 by an inlet vacuum created by intake strokes of the engine 12. Fuel is directly injected by the fuel injection system 14 into the cylinders 30. The air and fuel mixes in the cylinders 30 and heat from the compression and/or electrical energy ignites the air and fuel mixture. The piston 32 in the cylinder 30 drives a crankshaft 38 of the engine 12 to produce drive torque. Combustion exhaust within the cylinder 30 is forced out through exhaust conduits 40.

The engine control module 16 may control the fuel injection system 14 based on speed of the crankshaft 38. Speed and/or rotation of the crankshaft 38 may be detected by a crankshaft sensor 42. The engine control module 16 may control injector timing based on a crankshaft speed signal CS generated by the crankshaft sensor 42. A crankshaft speed signal of, for example, zero indicates that the crankshaft 38 of the engine 12 is not rotating or is stationary. A crankshaft speed signal of, for example, greater than zero indicates that the crankshaft 38 is rotating or is not stationary.

Referring now also to FIG. 2, the fuel injection system 14 is shown. The fuel injection system 14 includes the engine control module 16, a low-pressure fuel line 100, a high-pressure fuel line 102 that is connected to the fuel rails 22, 24, and fuel injectors 104, 105. The fuel lines 100, 102 receive fuel by a respective one of a low-pressure fuel pump 106 and a high-pressure fuel pump 108. The low-pressure pump 106 may operate off of an electrical power source, such as a battery. The high-pressure pump 108 may operate off of the engine 12. The low-pressure pump 106 may provide a fuel pressure of, for example, 400 kilopascal (kPa=$10^3$ Pa)+/−50 kPa. The high-pressure pump 108 may provide a fuel pressure of, for example, 15 megapascal (mPa=$10^6$ Pa)+/−5 mPa.

In use, the engine control module 16 generates a low-pressure control signal LowP 110 to pump fuel from a fuel tank 112 to the low-pressure fuel line 100 via the low-pressure fuel pump 106. The engine control module 16 generates a high-pressure control signal HighP 114 to pump fuel into the cylinders 30. The high-pressure fuel pump 108 is used to increase pressure of the fuel received from the low-pressure fuel line 100. High-pressured fuel is provided to the high-pressure fuel line 102 and the fuel rails 22, 24. The high-pressured fuel is injected into the cylinders 30 via the fuel injectors 104, 105. Timing of the fuel injectors 104, 105 is controlled by the engine control module 16. Although a particular number of fuel rails and fuel injectors per fuel rail are shown, any number of fuel rails and corresponding fuel injectors may be included.

The engine control module 16 controls the fuel pumps 106, 108 in response to various sensor inputs, such as a fuel rail pressure signal FR 116 from a fuel rail pressure sensor 118. Fuel rail pressure sensors may be connected to and detect pressure in one or more of the fuel rails 22, 24, 102. The fuel rail pressure sensor 118 is shown as one example. The engine control module 16 may generate various control signals, such as the low-pressure control signal 110, the high-pressure control signal 114, and a fuel injector control signal FI 120. The fuel injector control signal 120 may be used to control the opening and closing of the fuel injectors 104, 105. The low-pressure control signal 110 may be used to control operation of the low-pressure fuel pump 106. The high-pressure control signal 114 may be used to control operation of the high-pressure fuel pump 108.

Referring now also to FIG. 3, the fuel injection system 14 is shown illustrating the purge control system 18 and may be associated with a particular vehicle. The purge control system 18 includes an initialization module 200, a purge control module 202, a fuel pump module 204, and a fuel injection control module 206.

The initialization module 200 receives signals from sensors 208 via hardware input/output (HWIO) devices 210 to generate an initialization signal. The sensors 208 may include the crankshaft sensor 42, the fuel rail pressure sensor 118, and other sensors 212. The other sensors 212 may include, but are not limited to, an intake air temperature (IAT) sensor, a humidity IAT sensor, and/or an oxygen sensor. The initialization signal is generated based on the crankshaft speed signal CS, the fuel rail pressure signal FR, and one or more stored vehicle and/or engine status values. The vehicle and/or engine status values may be stored in memory 220 and may include an initial purge value 214 and an assembly-line monitoring value 218.

The initial purge value 214 indicates whether the fuel injection system 14 has been primed and the fuel injectors 104,105 have been purged since the manufacturing of the vehicle. An initial purge value of, for example, FALSE may indicate that a purge event has not been performed. An initial purge value of, for example, TRUE may indicate the fuel injection system 14 has been purged.

The assembly-line monitoring value 218 indicates whether a fuel system prime request is received and/or a prime is being performed. The prime is to put fuel into the fuel injection system 14 before starting the engine 12 to insure a sufficiently rich fuel/air mixture at the start. The fuel system prime request may be triggered in an assembly plant by a test tool or by a predetermined pedal stomp sequence. The pedal stomp sequence may include the actuating of, for example, brake and gas pedals. An assembly-line monitoring value of, for example, FALSE may indicate that the fuel system prime request is not received and/or a prime is not being performed. An assembly-line monitoring value of, for example, TRUE may indicate that fuel system prime request is received and/or a prime is being performed. The values 214, 218 may be accessed via the HWIO devices 210.

The HWIO devices 210 may include an interface control module 222 and hardware interfaces/drivers 224. The interface control module 222 provides an interface between the purge control module 202, the fuel pump module 204, the fuel injection control module 206, and the hardware interfaces/drivers 224. The hardware interfaces/drivers 224 control operation of, for example, fuel injectors 104, 105, fuel pumps 106, 108, and other engine system devices. The other engine system devices may include, but are not limited to, ignition coils, spark plugs, throttle valves, solenoids, etc. The hardware interface/drivers 224 also receive sensor signals, which are communicated to the respective control modules. The sensor signals may include the crankshaft speed signal CS and the fuel rail pressure signal FR.

The HWIO devices 210 may also include a boosting control module 228. When the purge control module 202 receives the initialization signal, the boosting control module 228 determines whether the hardware drivers 224 for the fuel injectors 104, 105 are ready for operation. The boosting control module 228 controls the hardware drivers 224 for the fuel injectors 104, 105 to ensure the drivers are charged sufficiently to operate opening of the fuel injectors 104, 105. When the boosting control module 228 enables the drivers, the purge control module 202 may generate a purge signal to initiate purging of the fuel injection system 14. The purge control module 202 may transmit the purge signal to the fuel pump module 204, the fuel injection control module 206, and an injection period timer 230.

When the fuel pump module 204 receives the purge signal, the fuel pump module 204 activates the actuators 226 via the HWIO devices 210. The fuel pump module 204 activates the low-pressure fuel pump 106 for purging of the fuel injection system 14.

When the fuel injection control module 206 receives the purge signal, the fuel injection control module 206 activates one or more of the fuel injectors 104, 105 via the HWIO devices 210. The fuel injection control module 206 may activate the fuel injectors 104, 105 based on the pulse width of the purge signal. The fuel injectors 104, 105 may be opened and closed sequentially and for a predetermined period to remove air from the fuel injection system 14.

The fuel injectors 104, 105, and the low-pressure fuel pump 106 may be deactivated based on at least one of a purge completion signal, the crankshaft speed signal, and the fuel rail pressure signal. The purge completion signal is generated by the purge control module 202 based on a counter 232. The injection period timer 230 may include the counter 232. The counter 232 may be incremented by one after completion of a purge event for M of N fuel injectors, where M is an integer and N is an integer greater than zero. M may correspond to a selected number of the fuel injectors 104, 105. N may correspond to a total number of the fuel injectors 104, 105. The purge completion signal indicates that the M of the N injectors has been opened and closed at least once for purging of the fuel injection system 14. When the counter is less than or equal to M, purging of the fuel injection system 14 continues by opening the next one of the M fuel injectors. When the counter is greater than or equal to M, the purge control module 202 generates the purge completion signal. Purging of the fuel injection system 14 may be ceased based on the purge completion signal.

Additionally, the injection period timer 230 accesses a system clock 234 via the HWIO devices 210 to receive an initial timestamp of, for example, when the M of the N fuel injectors 104, 105 is initially opened. The injection period timer 230 compares the initial timestamp with a current timestamp, which may also be received from the system clock 234. When the difference between the timestamps is greater than a predetermined period, the purge completion signal is provided to the purge control module 202 to deactivate the M of the N fuel injectors 104, 105. The purge completion signal indicates that the predetermined period has lapsed. This may also be used to cease purging of the fuel injection system 14.

The purge control module 202 ceases purging of the fuel injection system 14 based on the crankshaft speed signal and/or the fuel rail pressure signal. When the crankshaft speed signal indicates that the crankshaft 38 is rotating or not stationary, the purge control module 202 may signal the fuel pump module 204 to deactivate the low-pressure fuel pump 106 and the fuel injection control module 206 to deactivate the M of the N fuel injectors 104, 105.

When the fuel rail pressure signal indicates that the fuel rail pressure is greater than a predetermined threshold, the purge control module 202 may signal the fuel pump module 204 to deactivate the low-pressure fuel pump 106 and the fuel injection control module 206 to deactivate the M of the N fuel injectors 104, 105.

Figure 4:
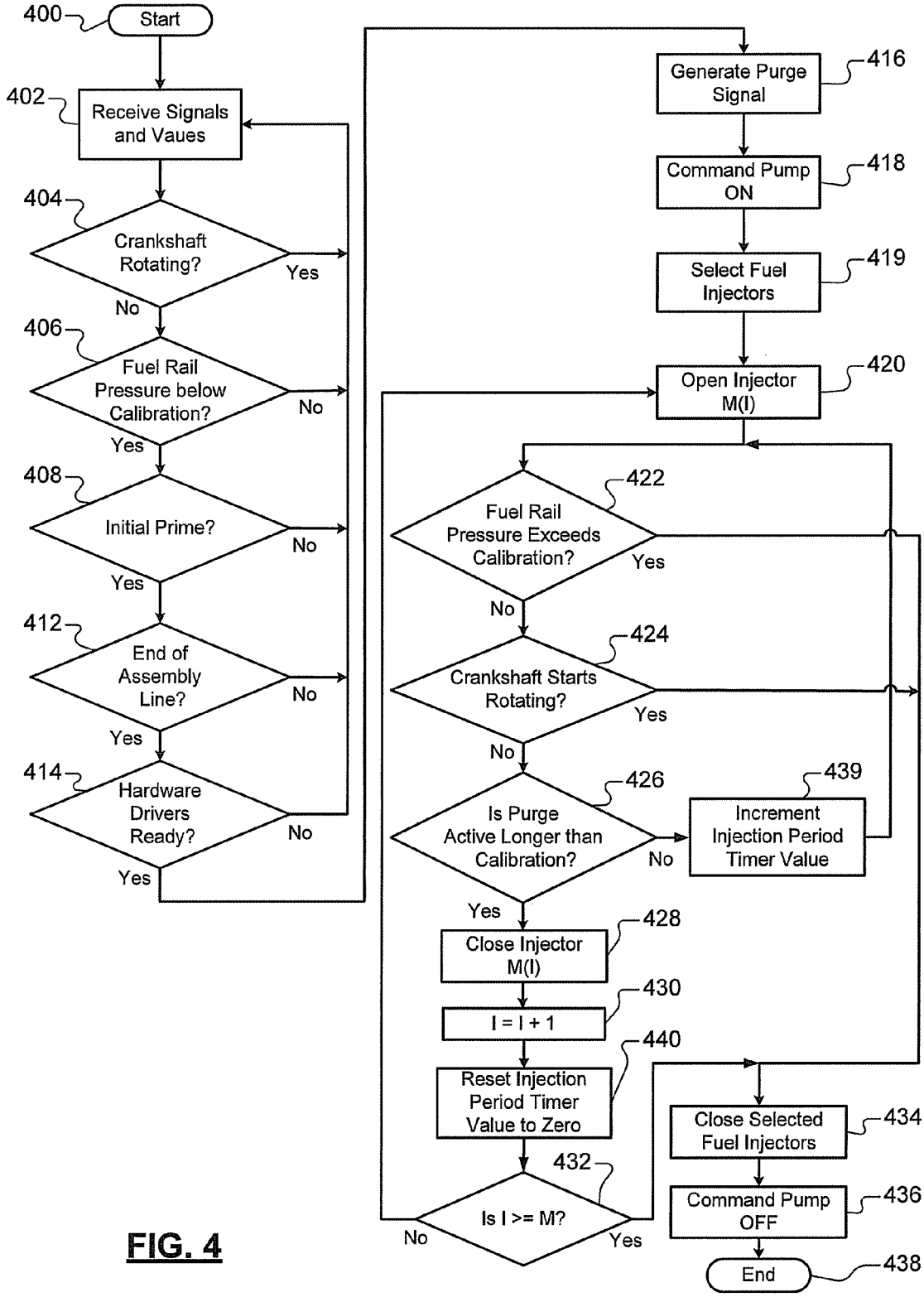
FIG. 4 illustrates a method of purging a fuel injection system in accordance with an embodiment of the present disclosure.

Referring now also to FIG. 4, a method of purging a fuel injection system, such as the fuel injection system 14, is shown. Although the following steps are primarily described with respect to the embodiments of FIGS. 1-3, the steps may be modified to apply to other embodiments of the present invention.

The method may begin at step 400. In step 402, signals from the sensors 208 and values in the memory 220 may be received and/or generated. The signals include the crankshaft speed signal CS and the fuel rail pressure signal FR. The values include the vehicle and/or engine status values, such as the initial purge value 214 and the assembly-line monitoring value 218. The values may be transmitted to modules, such as the initialization module 200, the purge control module 202, the fuel pump module 204, the fuel injection control module 206, and the injection period timer 230, via the HWIO devices 210.

In step 404, when the crankshaft speed signal CS indicates that the crankshaft 38 is not rotating, control may proceed to step 406. When the crankshaft speed signal CS is greater than zero and/or indicates that the crankshaft 38 is rotating, control may return to step 402.

In step 406, when the fuel rail pressure signal FR indicates that a fuel rail pressure is less than or equal to a predetermined threshold, control may proceed to step 408. Control may return to step 402 when the fuel rail pressure is greater than the predetermined threshold.

In step 408, when the initial purge value 214 indicates that a purge event has not been performed since the manufacturing of a corresponding vehicle, control may proceed to step 410. Otherwise, control may return to step 402.

In step 412, when the assembly-line monitoring value 218 stored in the memory 220 indicates that the vehicle is at an end of an assembly line, control may proceed to step 414. Otherwise, control may return to step 402.

In step 414, the boosting control module 228 may determine whether the hardware interfaces/drivers 224 are charged to operate opening and closing of the fuel injectors 104, 105. When the hardware drivers 224 are ready, control may proceed to step 416. Otherwise, control may return to step 402.

In step 416, the purge control module 202 generates a purge signal and transmits the purge signal to the fuel pump module 204, the fuel injection control module 206, and the injection period timer 230. In step 418, the fuel pump module 204 activates the low-pressure fuel pump 106 for an initial prime and refrains from activating the high-pressure fuel pump 108. The high-pressure fuel pump 108 performs as a pass-through when deactivated.

In step 419, the purge control module 202 selects the M of the N fuel injectors 104, 105. M may vary depending on a configuration type of the engine 12. The fuel injectors at higher elevation points on the engine 12 may be selected, opened, and purged, as air in a fuel injection system tends to be located at the highest points. This selection reduces purge time. For example, when the fuel injectors 104 are at a higher elevation level than the fuel injectors 105, the fuel injectors 104 may be selected, opened, and purged. The fuel injectors 105 may not be selected, opened, and purged. Each of the selected injectors may remain open for a predetermined period. In one embodiment, each injector is purged once.

In step 420, the fuel injection control module 206 sequentially activates the fuel injectors 104, 105 by sending a predetermined pulse width. The fuel injection control module 206 opens a first one of the selected M of the N fuel injectors 104, 105, or injector M(I) via HWIO devices 210 for a calibrated time period determined by the purge control module 202 using calibration software 236 in the memory 220. I is an index of M. The fuel injection control module 206 deactivates the first one of the selected M of the N fuel injectors 104, 105 before activating a second one of the selected M of the N fuel injectors 104, 105.

In step 422, when the fuel rail pressure signal FR exceeds a predetermined value, control may proceed to step 434. Otherwise, control may proceed to step 424. The predetermined value may, for example, be calibrated and set at approximately 600 kPa+/−200 kPa.

In step 424, when the crankshaft speed signal CS indicates that the crankshaft 38 is rotating, control may proceed to step 434. Otherwise, control may proceed to step 426.

In step 426, when one or more of the selected fuel injectors 104, 105 are open longer than the predetermined period, control may proceed to step 428. Otherwise, control may proceed to step 439. In step 439, the injection period timer 230 increases time spent for purging of the injector M(I), then control may proceed to step 422. An injection period timer value 231 of the injection period timer 230 may be incremented. For example, the injection period timer 230 accesses a system clock 234 via the HWIO devices 210 to receive an initial timestamp of when the injector M(I) is initially opened. The injection period timer 230 compares the initial timestamp with a current timestamp, which may also be received from the system clock 234. The difference between the timestamps may be the injection period timer value 231.

Steps 422 and 426 aid in preventing a hydrolock situation of the engine 12. The amount of fuel pumped into a fuel injection system may be estimated by the ON time of and the pressure provided by the low-pressure fuel pump 106. Step 422 also prevents the purging of the fuel injection system 14, for example, by a system developer or a dealership when fuel rail pressure is higher than the predetermined value.

In step 428, the fuel injection control module 206 deactivates the M of the N fuel injectors 104, 105, to prevent a hydrolock state of injected fuel into one or more of the cylinders 30. In step 430, the counter 232 increments the index I by one. In step 440, the injection period timer 230 is reset to 0.

In step 432, when I is less than M, control may proceed to step 420. When I is greater than or equal to M, control may proceed to 434. In step 434, the selected fuel injectors are closed. In step 436, the fuel pump module 204 deactivates the low-pressure fuel pump 106, and the purge control module 202 may cease purging of the fuel injection system 14. Then, control may end at step 438.

The above described steps are meant to be illustrative examples; the steps may be performed sequentially, synchronously, simultaneously, continuously, during overlapping time periods or in a different order depending upon the application.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A system comprising:

an initialization module that generates an initialization signal based on a crankshaft speed signal and at least one of an initial purge value and an assembly-line monitoring value; and a purge control module that generates a purge signal to purge air from a fuel injection system of an engine when the crankshaft speed signal indicates that a crankshaft of the engine is stationary and based on the initialization signal.

2. The system of claim 1 further comprising memory that stores the initial purge value and the assembly-line monitoring value, wherein the initial purge value indicates whether the fuel injection system has been primed and fuel injectors of the fuel injection system have been purged, and wherein the assembly-line monitoring value indicates whether a fuel system prime is being performed.

3. The system of claim 1 further comprising a fuel pump module that activates a first pump based on the purge signal.

4. The system of claim 1 further comprising a fuel injection control module that selectively activates M of N fuel injectors of the fuel injection system based on the purge signal, where M is an integer and N is an integer greater than 1.

5. The system of claim 4 wherein the fuel injection control module sequentially activates the M of the N fuel injectors.

6. The system of claim 4 wherein the fuel injection control module deactivates a first one of the M of the N fuel injectors before activating a second one of the M of the N fuel injectors.

7. The system of claim 1 further comprising an injection period timer that increments a counter value when purging of the fuel injection system is completed for one of the M fuel injectors, wherein the purge control module deactivates purging of the fuel injection system when the counter value is greater than or equal to M.

8. The system of claim 7 wherein the injection period timer measures a time difference between an initial timestamp and a current timestamp of a purging event of the one of the M fuel injectors, and wherein the purge control module deactivates purging of the one of the M fuel injectors when an injection period timer value of the injection period timer is greater than a predetermined period.

9. The system of claim 1 wherein the purge control module deactivates purging of the fuel injection system when the crankshaft speed signal is greater than zero.

10. A system comprising:

an initialization module that generates an initialization signal based on a fuel rail pressure signal and at least one of an initial purge value and an assembly-line monitoring value; and a purge control module that generates a purge signal to purge air from a fuel injection system of an engine when the fuel rail pressure signal is less than or equal to a predetermined value and based on the initialization signal.

11. The system of claim 10 wherein the purge control module deactivates purging of the fuel injection system when the fuel rail pressure signal exceeds the predetermined value.

12. A method of purging air from a fuel injection system of an engine comprising:

generating an initialization signal based on a crankshaft speed signal, a fuel rail pressure signal, and at least one of an initial purge value and an assembly-line monitoring value;

storing the initial purge value and the assembly-line monitoring value in memory; and generating a purge signal when the crankshaft speed signal is equal to zero and the fuel rail pressure signal is less than a predetermined value and based on the initialization signal.

13. The method of claim 12 wherein the purge signal is generated based on a boosting control signal, and wherein the boosting control signal is generated based on a charged state of a fuel injector driver.

14. The method of claim 12 further comprising:

sequentially activating M of N fuel injectors of the fuel injection system based on the purge signal, where M is an integer and N is an integer greater than 1; and then deactivating the M of the N fuel injectors based on the fuel rail pressure signal and the crankshaft speed signal.

15. The method of claim 14 further comprising:

storing an initial timestamp and a current timestamp corresponding to an injection period timer for each of M of the N injectors;

measuring a time difference between the initial timestamp and the current timestamp for the M of the N fuel injectors; and deactivating the M of the N fuel injectors when an injection period timer value of the injection period timer exceeds a predetermined period.

16. The method of claim 15 further comprising:

incrementing a counter value for the M of the N fuel injectors; and deactivating the M of the N fuel injectors when the counter value is greater than M.

* * * * *